US005762262A

United States Patent [19]

Martin

[11] Patent Number: 5,762,262

[45] Date of Patent: Jun. 9, 1998

[54] COLLAPSIBLE CONTAINERS

[76] Inventor: Peter John Martin, 75 Ngatai Street, Manaia, Taranaki 4851, New Zealand

[21] Appl. No.: 765,221

[22] PCT Filed: May 5, 1995

[86] PCT No.: PCT/NZ95/00037

§ 371 Date: Jan. 6, 1997

§ 102(e) Date: Jan. 6, 1997

[87] PCT Pub. No.: WO96/34804

PCT Pub. Date: Nov. 7, 1996

[51] Int. Cl.[6] ..... B65D 5/4805

[52] U.S. Cl. ..... 229/120.21; 53/246; 229/117.01; 493/311

[58] Field of Search ..... 229/101, 117.01, 229/117.07, 117.05, 120.09, 120.21; 206/219; 493/153, 311, 912; 53/246

[56] References Cited

U.S. PATENT DOCUMENTS

| | | | |
|---|---|---|---|
| 894,669 | 7/1908 | Rollestone | 229/117.07 |
| 2,791,367 | 5/1957 | Mefford | 229/101 |
| 3,032,253 | 5/1962 | Younger | 229/101 |
| 4,160,519 | 7/1979 | Gorham | 229/101 |
| 4,377,917 | 3/1983 | Guidry | 229/117.01 |
| 4,722,473 | 2/1988 | Sandrini et al. | 229/117.01 |
| 5,230,690 | 7/1993 | Adkinson et al. | 493/311 |
| 5,381,892 | 1/1995 | Allen | 229/120.09 |

FOREIGN PATENT DOCUMENTS

| | | | |
|---|---|---|---|
| 724505 | 12/1965 | Canada | 229/117.01 |
| 18758 | 11/1980 | European Pat. Off. . | |
| 3533561 | 4/1987 | Germany . | |

*Primary Examiner*—Gary E. Elkins
*Attorney, Agent, or Firm*—Young & Thompson

[57] ABSTRACT

A collapsible container (30) includes a collapsible section (31), having orthogonally shaped walls (3), each having a fold line (6) extending in a common direction from a bottom corner (7) on a bottom edge (8) to a diagonally opposite top corner (9) on a top edge (10). A base section (32) and top section (33) which may or may not be collapsible are attached to opposite sides of the collapsible section (31). The container (30) may be collapsed or extended by twisting the base section (32) relative to the top section (33). It thus provides, for example, a convenient means for containing products such as concentrates or two pot mixes, which can be mixed within the container (30) when extended.

10 Claims, 4 Drawing Sheets

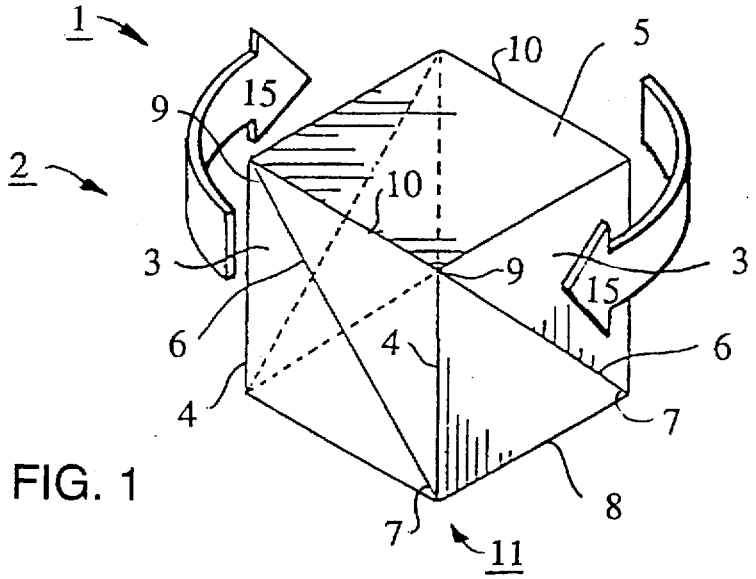
FIG. 1
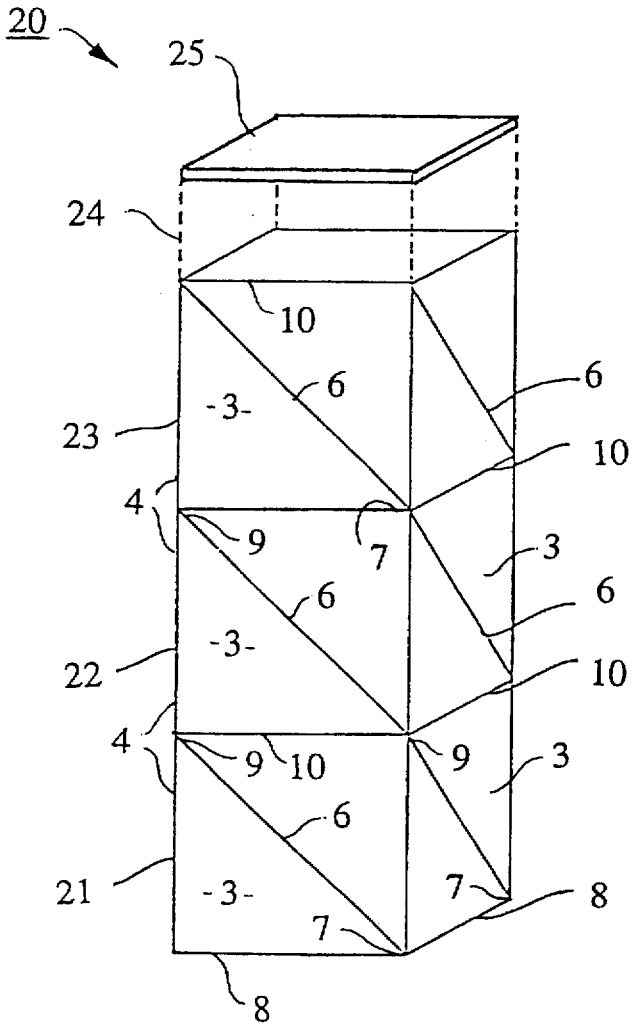
FIG. 2A
FIG. 2B
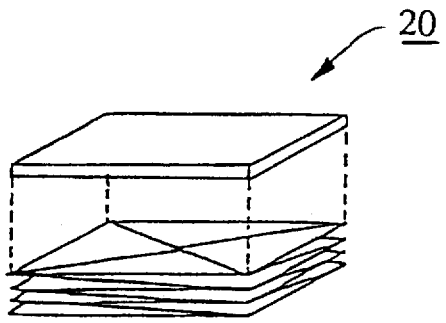

COLLAPSIBLE CONTAINERS

TECHNICAL FIELD

The present invention relates to collapsible containers.

For convenience only, the present invention will be described with reference to reusable collapsible containers which can be folded after use for storage, and to collapsible containers for the packaging of consumable products such as foods, beverages and chemicals, for which the invention may be particularly applicable. However, it is to be understood that it is not to be limited as such. Moreover, because the invention may have other applications it is to be understood that the background art and possible embodiments of the invention as discussed below are given by way of example only.

BACKGROUND ART

There have been various proposals for reusable collapsible containers which can be folded after use for storage. For example U.S. Pat. No. 4,405,077 discloses an arrangement for a collapsible shipping container of an open box shape, which can be folded to a generally flat collapsed condition after use, for shipping back to the point of origin. Folding is achieved by having diagonal fold lines formed on opposite end walls, each extending diagonally from a bottom comer to a diagonally opposite top comer of the end wall, and diagonal fold lines formed on opposite side walls each extending diagonally from a bottom comer to a point on an upper edge of the respective side wall, spaced a short distance from the diagonally opposite corner. One of the side walls is also provided with a second fold extending from the point on the upper edge to the lower opposite corner, thus forming a second triangularly shaped side wall section which can be folded inwards, to initiate folding of the walls to a collapsed condition.

Although such an arrangement enables rectangular shaped containers of varying dimensions, to be folded flat, the folding operation involves a particular sequence and is thus complicated. Moreover, due to the non symmetrical arrangement of the fold lines on the side walls (for example, the requirement for two fold lines on one of the side walls), manufacturing costs are increased.

With regards to containers for the packaging of consumable products, since conventional packaging does not generally allow for changing the configuration of the container during use, various problems arise.

For example, in the case of packaging concentrated products which must be reconstituted before use. In this case at the time of use, the concentrated ingredients packaged in the container must be mixed with a required amount of dilutent in a separate larger container, Alternatively, the volume of the container may be made sufficiently large to hold the additional dilutent required for reconstitution. Such packaging is either inconvenient in that it requires a further container to be used with some means for measuring the required amount of dilutent, or alternatively is of such a volume that it takes up valuable storage space.

Similar problems arise with products such as two pot mixes or multiple pot mixes, where two or more ingredients must be stored separately and then mixed together before use. In this case the ingredients must be stored in separate containers, and then mixed together in an additional container. This is again inconvenient in that separate containers are required. Moreover there is the danger of spillage, and contamination of the products, when being mixed.

Another problem resides in the storage of dry foods such as biscuits, coffee, flour etc, and in the storage of chemicals such as paints, where the opening of the container and removal of some of the contents leaves the remaining contents exposed to a larger volume of air.

DISCLOSURE OF THE INVENTION

It is therefore an object of the present invention to address the foregoing problems, or to at least provide the public with a useful choice.

Further aspects and advantages of the present invention will become apparent from the ensuing description which is given by way of example only.

According to one aspect of the present invention there is provided a collapsible container comprising; at least one collapsible section having a predetermined number of orthogonally shaped collapsible walls joined at common edges so as to form an enclosure, each of the collapsible walls having a fold line extending in a common direction from a bottom comer on a bottom edge thereof to a diagonally opposite top corner on a top edge thereof, and a base section connected to the bottom edges of said collapsible walls to provide a barrier at a base end of the enclosure.

With such an arrangement the collapsible section may be collapsed by a predetermined amount (depending on the configuration of the walls) by applying a force to cause each of the collapsible walls to fold inwards about its respective fold line. For example this may be achieved by applying a lateral twisting force between top and bottom ends of the container and/or applying an inwards force along one or more of the fold lines, by for example, pressing inwards or applying a vacuum to the interior.

The base section may be in the form of a planar section which partially or completely closes off the open end as required or desired. For example, in the case of a cage or basket type container, this may be in the form of a mesh, while in the case of a container for powder or liquid, this may be in the form of a solid panel. Alternatively the base section may be in the form of a collapsible or non-collapsible section of any shape and size as required or desired. For example, this may comprise a number of orthogonally shaped collapsible or non-collapsible walls, being the same number as the number of collapsible walls of the at least one collapsible section, joined at opposite edges so as to form a common enclosure with the enclosure of the at least one collapsible section, with a planar member which provides a barrier at the base end to the common enclosure.

Moreover, the collapsible container may be constructed with the at least one collapsible section provided between two other sections which may or may not be collapsible.

The above constructions provides a collapsible container which can be easily manufactured due to the symmetrical arrangement of the fold lines, and wherein the at least one collapsible section may be either fully collapsed, or partially collapsed (depending on the configuration of the walls), due to the fold lines on the walls thereof. In the case of disposable packaging, further collapsing of a container which is only partially collapsible may be achieved by further application of force to deform the walls.

According to another aspect of the present invention there is provided a container substantially as described above wherein the at least one collapsible section comprises four square shaped walls.

In this case the connection to the base section will necessarily involve a square shape, and since the length of the diagonal fold lines of the walls will then be equal to the length of diagonals from opposite comers of the square shape, the walls may be folded so as lie substantially flat, and also so as to substantially close off the full area of the square shape.

Hence in the case of a collapsible container having a planar square shaped base section and wherein the sections are all collapsible with four square shaped walls, the walls may all be collapsed so as to lie flat on top of each other on the base section, thereby enabling the container to be folded flat.

According to a further aspect of the present invention there is provided a collapsible container substantially as described above, further comprising a cover member for providing a barrier at an end of the enclosure opposite to the base end. Such a container may be suitable as a packaging container, with the cover member either partially or fully closing off the open end, as required or desired. For example, the cover member may be formed integrally with the walls of the adjacent section, such as with the arrangement of a milk carton cover, so as to be foldable to open or close the open end. With such a packaging container, the volume may be varied by collapsing or expanding the collapsible sections. The packaging container may be made up entirely of collapsible sections having square shaped walls, thereby enabling the container to be either completely folded flat after use, or to be expanded for use, for example when used for reconstituting a product contained in one of the sections.

Furthermore, the packaging container may be made with a collapsible section having square shaped walls provided between two other sections, which may or may not be collapsible, so that the square shaped walls can be collapsed so as to lie substantially flat and provide a barrier between respective enclosures formed by the two other sections. This arrangement may be suitable for packaging containers wherein the two sections on opposite sides of the collapsible section are used to contain ingredients, such as for a two pot mix. In this case additional sealing may be provided to ensure that the folded square shaped walls form an impervious barrier between the enclosures, According to other aspects of the present invention there are provided methods of manufacturing the abovementioned collapsible containers, and a method and apparatus for using such containers.

BRIEF DESCRIPTION OF THE DRAWINGS

Further aspects of the present invention will become apparent from the ensuing description which is given by way of example only and with reference to the accompanying drawings in which:

FIG. 1 is a perspective view of a collapsible container according to one possible embodiment of the invention.

FIGS. 2(*a*) and (*b*) are perspective views of a packaging container according to another possible embodiment of the invention in extended and collapsed conditions respectively;

BEST MODES FOR CARRYING OUT THE INVENTION

Figures 3A, 3B, 3C:
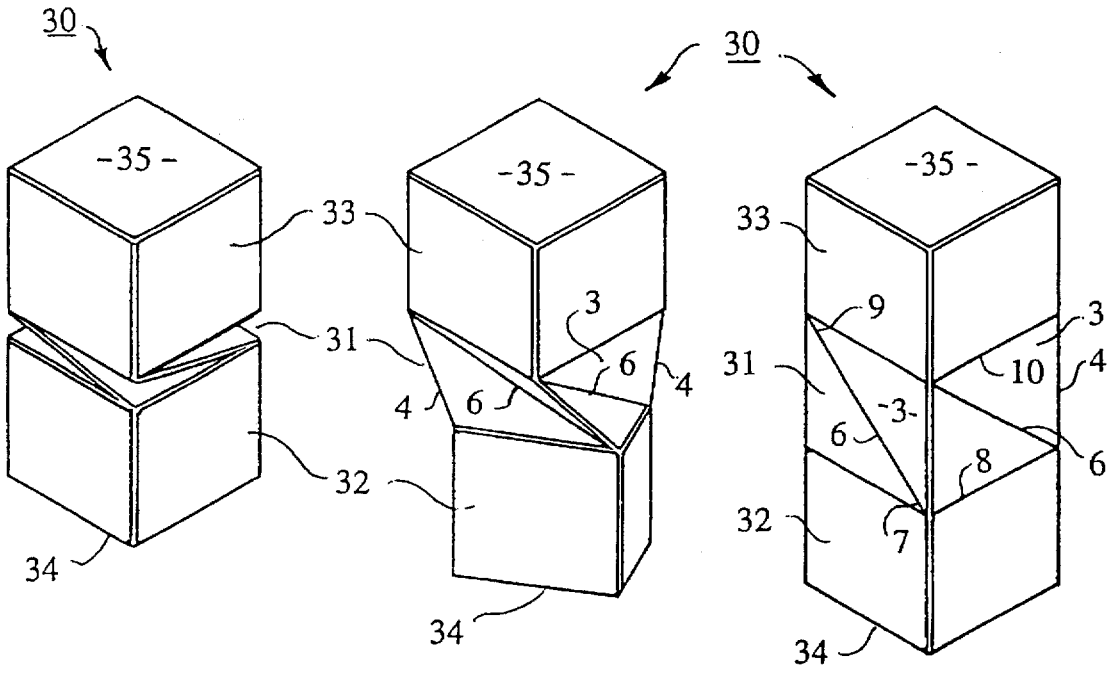
FIGS. 3(*a*), (*b*) and (*c*) are perspective views of a packaging container suitable for a two pot mix, showing stages of opening from a storage condition.
Figure 4A:
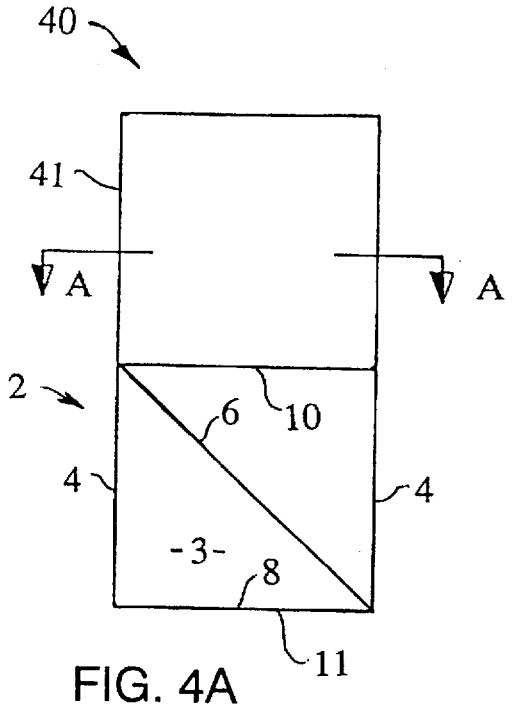
FIGS. 4(*a*), (*b*), (*c*) and (*d*) are perspective views for explaining the folding of a collapsible section.
Figure 4C:
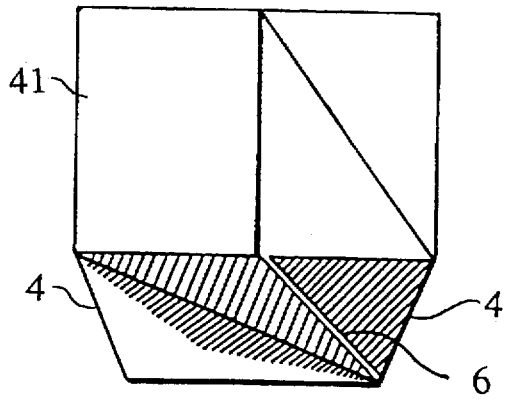
Figure 4B:
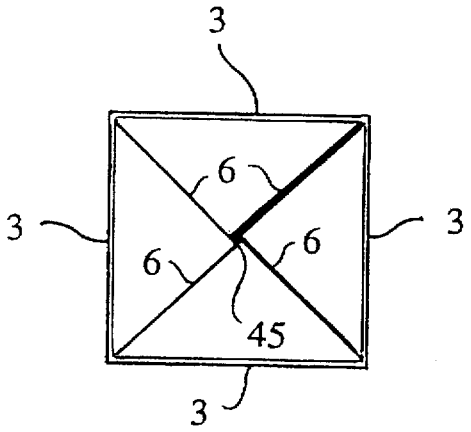
Figure 4D:
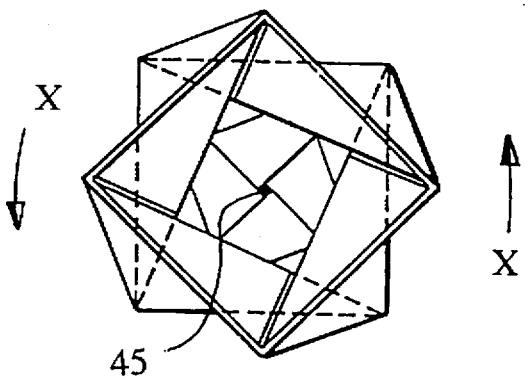

Embodiments of the invention will now be described, by way of example only and with reference to the accompanying drawings.

As shown in FIG. 1, a collapsible container according to an embodiment of the present invention generally indicated by arrow 1, is made of a stiff material such as a suitably surfaced paper board, cardboard, plastic or the like The container 1 has a single collapsible section generally indicated by arrow 2 made up of four square collapsible walls 3 joined at common edges 4 so as to form an enclosure 5 inside. Each of the collapsible walls 3 has a fold line 6 extending in a common direction from a bottom corner 7 on a bottom edge 8 thereof to a diagonally opposite top corner 9 on a top edge 10 thereof. A base section 11 (not visible in FIG. 1) in the form of a substantially planar sheet is connected to the bottom edges 8 of the collapsible walls 3 to provide a barrier at a base end of the enclosure 5.

With this arrangement for the collapsible container 1, the collapsible section 2 can be collapsed to lie flat on the base section 11, by applying a force to cause each of the collapsible walls 3 to fold inwards about its respective fold line 6, for example by applying a lateral twisting force between top and bottom ends of the container I in the direction of the arrow 15, and/or pressing in an inwards direction along one or more of the fold lines 6.

Such a collapsible container I may be suitable for example for a shipping container, which can be folded flat after use for storage.

FIGS. 2(*a*), and (*b*) show a collapsible packaging container generally indicated by arrow 20 according to another possible embodiment of the present invention in extended and collapsed conditions respectively. As shown in FIG. 2(*a*), the packaging container 20 comprises a plurality of collapsible sections 21, 22, 23, 24 etc. (the top section 24 is shown in dotted outline to indicate that more sections are possible). The collapsible sections 21, 22, 23, 24 etc. are similar to the collapsible section 2 of FIG. 1, and components having a similar function are indicated with the same numerals, The packaging container 20 is provided with a lid 25 for closing off the top end.

Such a packaging container 20 may be used as a packaging container which can be partially or fully collapsed as the contents are removed. For example as a packaging container for dry foods such as biscuits, coffee, flour etc, or as a container for the storage of chemicals such as paints. The packaging container 20 may also be used as a general goods container which can be fully collapsed after use as shown in FIG. 2(*b*), for storage or disposal.

Moreover the packaging container 20 may be used in a partially collapsed condition as a packaging container for concentrated products, with the base section 21 (or the top section 24) extended and remaining sections 22, 23, 24 etc. (or 21, 22, 23 etc.) collapsed, thus taking up a minium volume for storage. The remaining sections 22, 23, 24 etc. (or 21, 22, 23 etc.) may then be extended when the contents are to be reconstituted, so as to contain the dilutent. In this case the lid 25 may be made re-sealable so that it can be closed after filling with the dilutent, to enable shaking and mixing of the contents. Moreover, the volumes of the sections 21, 22, 23, 24 etc. may be such as to enable the correct amount of dilutent to be measured.

The filling of such a container 20 for the case of concentrated-products for example, may involve; collapsing all the sections 21, 22, 23 etc. except the top section 24 by for example, twisting the top section 24 relative to the base section 21, and/or applying an inwards force along one or more of the fold lines 6, by pressing inwards or applying a vacuum to the interior. Then filling the top section 24 with the concentrate, and closing the top section with the lid 25.

Such an operation may be carried out by one or more machines specially designed for the operation.

Reconstituting the concentrate ready for use may involve: removing or opening the lid 25, extending the collapsed sections 21, 22, 23 etc., for example by twisting the top section 24 relative to the base section 21 in the opposite direction to that for collapsing, so that the concentrated product flows into the expanded sections 21, 22, 23 etc. of the container 20. Then adding the required amount of dilutent, and replacing or closing the lid 25, and shaking the container 20 to mix the concentrate with the dilutent.

The filling operation may of course be such that the concentrate is contained in the base section 21 instead of the top section 24. However in the case of powder concentrate it may be preferable to contain this in the top section 24 so as to benefit from the drop into the expanded sections 21, 22, 23 etc. as the container 20 is expanded, thus helping to break up the powder an facilitate the subsequent mixing.

FIGS. 3(*a*), (*b*), and (*c*) show a two pot mix collapsible container generally indicated by arrow 30 according to another possible embodiment of the present invention, adapted for packaging two pot mixes such as an epoxy resins. In this embodiment an intermediate collapsible section 31, similar to the collapsible section 2 of FIG. I (with components having a similar function indicated with the same numerals), is provided between a base section 32 and a top section 33, respectively provided with closable ends 34, 35.

One or both of the sections 32, 33 may be collapsible depending on requirements, for example to simplify manufacturing, or to enable the container 30 to be fully collapsed after use for disposal. Moreover the shape and volumes of the sections 32, 33 may be made different as required or desired, For example the volumes may be such as to give the correct mixing ratio for the two pot mix ingredients, With the container 30, the walls of the collapsible section 31 are square shaped. Hence, when these are folded they lie substantially flat (as described later with reference to FIG. 4), and provide a barrier between the respective enclosures formed by the sections 32, 33.

Hence ingredients of a two pot mix contained in the respective enclosures may be effectively separated.

A method and apparatus for filling such a container 30 from the condition shown in FIG. 3(*c*) may involve: a step and apparatus for filling the base section 32 (which has the end 34 closed) with a first ingredient of a two pot mix, through the end 35 (which is opened for filling); a step and apparatus for folding the walls 3 of the intermediate section 31 about the fold lines 6 by twisting the top section 33 relative to the bottom section 32 as shown in FIG. 3(*b*), and continuing to twist to the condition shown in FIG. 3(*a*) wherein the walls 3 form a barrier between the top section 33 and the base section 32; a step and apparatus for sealing the folded walls 3, at least at a central portion of the barrier where the intersection of the fold lines 6 of the walls 3 may not seal completely; and a step and apparatus for filling the top section 33 with a second ingredient of the two pot mix, and then closing the open end 35.

Mixing the ingredients contained in the two pot container 30 may involve; twisting the top section 33 relative to the bottom section 32 in an opposite direction to that for folding the walls 3 to thereby break the seal and open the barrier between the two sections 32, 33 and expand the intermediate section 31, and then shaking the expanded container 30 to mix the ingredients.

Such an arrangement thus enables the ingredients to be mixed easily and in the correct proportions, and the danger of spillage, and contamination of the ingredients when being mixed is avoided.

FIGS. 4(*a*), (*b*), (*c*), and (*d*) show details and features related to a collapsible section wherein the collapsible walls are all square. Components having a similar function to the those of the previous embodiments are indicated with the same numerals.

FIG. 4(*a*) shows a side elevation view of a container 40 having a collapsible section 2, a base section in the form of a planar base 11 and a top section 41, while FIG. 4(*b*) shows an internal plan view along the lines A—A of FIG. 4(*a*) with the collapsible section 2 fully collapsed. Since the base 11 and the four walls 3 are all square shaped, then the length of the diagonal fold lines 6 of the walls 3 is equal to the length of the diagonals of the square base 11. Therefore as shown in FIG. 4(*b*), the walls 3 can be folded about their fold lines 6 so as to lie flat on the base 11, and also so that the folded walls 3 substantially cover the full area of the base 11, with possibly a very small aperture 45 at the intersection of the diagonal fold lines 6. When such a construction is used for example for the two pot mix container 30 described beforehand, then at least this aperture 45 must be sealed.

FIG. 4(*c*) and (*d*) are respective side elevation and plan views showing the configuration of the walls 3 in an intermediate condition between the collapsed condition of FIG. 4(*b*) and the extended condition of FIG. 4(*a*), caused by twisting the top portion 41 in the direction of the arrows X, X. In this condition the aperture 45 is shown to have opened slightly. In the case of a two pot mix container, this condition would coincide with rupture of the seal between the two ingredients.

Figure 5:
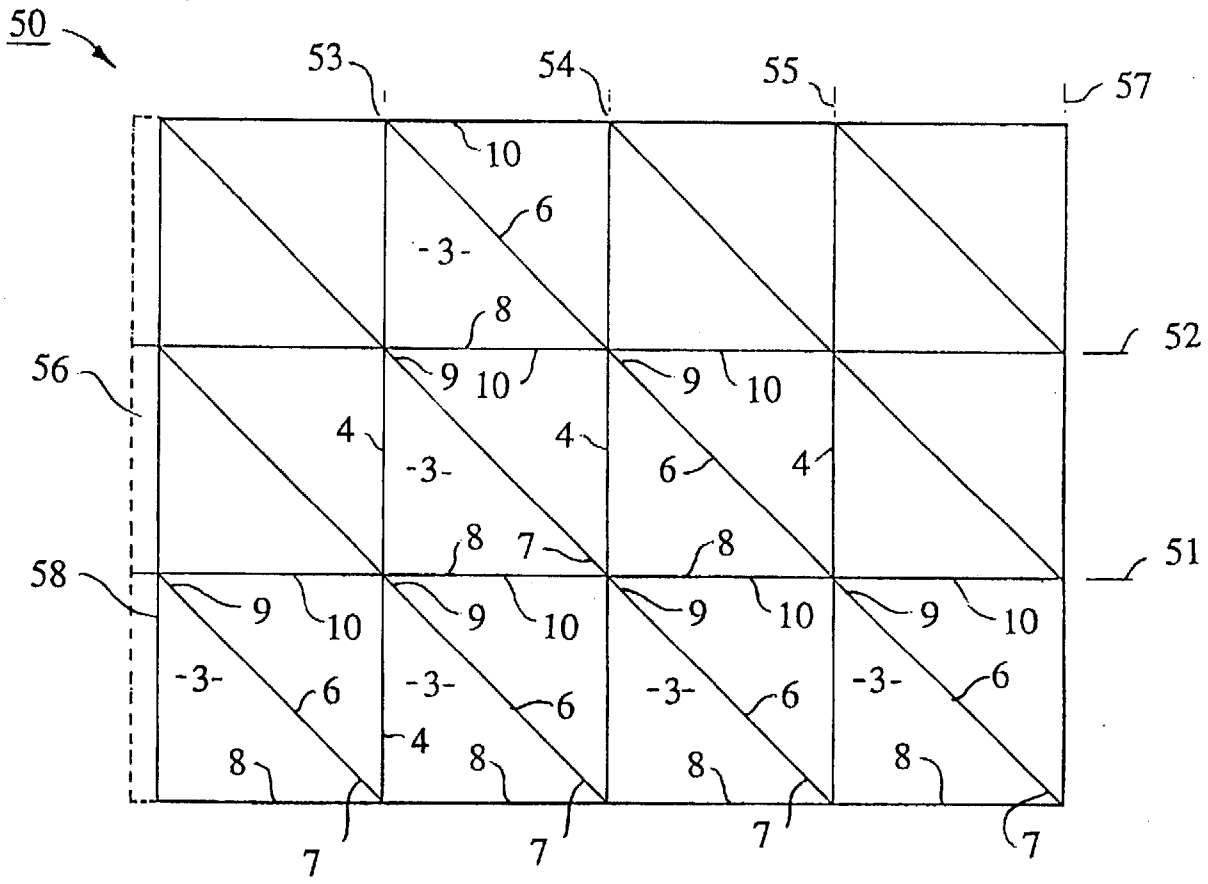
FIG. 5 is a plan view showing a blank used in the manufacture of a packaging container.

A method of manufacturing a container according to the present invention will now be described with reference to FIG. 5, which shows a sheet material blank 50 such as a cardboard blank, for manufacturing the collapsible two pot container 30 of FIG. 3. In this case however the top and bottom sections 32, 33 of the container 30 are made collapsible, so as to simplify construction. Parts of FIG. 5 corresponding to those of FIG. 1 and FIG. 3 are identified with the same numerals.

The method involves forming two first parallel fold lines 51, 52 defining the top and bottom edges 10, 8 of the collapsible walls 3 of the collapsible section 31 and respective top and bottom edges 10, 8 of the collapsible sections 32, 33. Second parallel fold lines 53, 54, 55 defining the common side edges 4 of the collapsible walls 3 are then formed orthogonal to the first parallel fold lines 51, 52. Diagonal fold lines 6 extending respectively in a common direction from bottom corners 7 on bottom edges 8 to diagonally opposite top corners 9 on top edges 10 are then formed on each of the collapsible walls 3. The collapsible walls 3 are then folded about their common edges 4 so as to form enclosures for each of the sections 31, 32, 33, with the two outer side edges 56, 57 joined together by a joining strip 58. Top and bottom covers are then provided to close off the top and bottom ends.

Although the above construction has been described in relation to the container 30 of FIG. 3, it will be apparent that the same blank 50 may be used to form a collapsible container having a single collapsible section. In this case the material for section 31 may be used to form the single collapsible section and the material for sections 32 and 33 used to form top and bottom covers, by for example cutting along the parallel lines 53, 54, 55 for either or both of these sections.

INDUSTRIAL APPLICABILITY

The container according to the present invention may be easily manufactured as a container for goods, with the added advantage of being easily collapsible for storage after use.

The container may also be used as a packaging container with various advantages due to its collapsible features. For example it provides a convenient means for packaging concentrated products, since the product can be reconstituted using the same container in an extended configuration. It will be appreciated however that it will have a wide variety of other industrial uses.

Aspects of the present invention have been described by way of example only and it should be appreciated that modifications and additions may be made thereto without departing from the scope thereof as defined in the appended claims.

I claim:

1. A collapsible container comprising:

a central collapsible section having in a non-collapsed condition four square shaped collapsible walls joined at common edges so as to form a first enclosure, each of said collapsible walls having a fold line extending in a central section common direction from a bottom corner on a bottom edge to a diagonally opposite top corner on a top edge;

a base section comprising four walls connected to the bottom edges of said four collapsible walls so as to form a second enclosure joined with said first enclosure, and a planar member which provides a sealed barrier at a base end to said base section; and a top section comprising four walls connected to the top edges of said four collapsible walls so as to form a third enclosure joined with said first enclosure, and an upper member which provides a sealed barrier at a top end to said top section, said first, second and third enclosures forming a common enclosure whose construction is such that said central collapsible section is collapsible by folding said collapsible walls about said fold lines to form overlapping triangular sections which provide a barrier between said top section and said base section, said barrier being sealable by applying sealing means to a central intersection region of said triangular sections.

2. A collapsible container according to claim 1, wherein the walls of said base section are collapsible, each having a fold line extending in a base section common direction from a bottom corner on a base section bottom edge to a diagonally opposite top corner on a base section top edge.

3. A collapsible container according to claim 2, wherein said base section common direction is the same as said central section common direction.

4. A collapsible container according to claim 3, wherein the walls of said top section are collapsible, each having a fold line extending in a top section common direction from a bottom corner on a top section bottom edge to a diagonally opposite top corner on a top section top edge.

5. A collapsible container according to claim 4, wherein said top section common direction is the same as said central section common direction.

6. A collapsible container according to claim 1, said collapsible walls being collapsed to provide said barrier, said barrier being sealed and said top section and base section containing different ingredients of a two pot mix.

7. A two pot mix container comprising:

a central collapsible section having in a non-collapsed condition four square shaped collapsible walls joined at common edges so as to form a first enclosure, each of said collapsible walls having a fold line extending in a common direction from a bottom corner on a bottom edge to a diagonally opposite top corner on a top edge;

a base section comprising four walls connected to the bottom edges of said four collapsible walls so as to form a second enclosure joined with said first enclosure, and a planar member which provides a sealed barrier at a base end to said base section; and a top section comprising four walls connected to the top edges of said four collapsible walls so as to form a third enclosure joined with said first enclosure, and an upper member which provides a sealed barrier at a top end to said top section, said central collapsible section being collapsed by folding said square shaped walls about said fold lines to form overlapping triangular sections which provide a barrier between said top section and said base section, said barrier being sealed by applying sealing means to a central intersection region of said triangular sections, and said top section and said base section containing different ingredients of a two pot mix.

8. A method of producing from a rectangular sheet material, a collapsible container having a central collapsible section disposed between a base section and a top section, said method comprising the steps of;

forming on said sheet material at a predetermined distance from top and bottom edges of said sheet material, first parallel fold lines defining top and bottom edges of four square shaped collapsible walls of said central collapsible section, and respective bottom and top edges of said top section and said base section;

forming orthogonal to said first parallel fold lines, and at the same distance apart, second parallel fold lines defining common side edges of said square shaped collapsible walls, and common side edges of said top and base sections, thereby defining collapsible walls of said central collapsible section, and side walls of said top and base sections;

forming on each of said collapsible walls diagonal fold lines extending in a common direction from a bottom corner on a bottom edge to a diagonally opposite top corner on a top edge; and folding said collapsible walls and said side walls of said top and base sections about their common edges so as to form an enclosure, with the two outer side edges of said collapsible walls joined, and the two outer edges of said side walls of said top and base sections joined.

9. A method of producing from a rectangular sheet material, a collapsible container according to claim 8, further comprising the step of forming on each of said side walls of said top and base sections diagonal fold lines extending in a common direction from a bottom corner on a bottom edge to a diagonally opposite top corner on a top edge.

10. A method of producing from a rectangular sheet material, a collapsible container according to claim 9, wherein said predetermined distance from top and bottom edges is such that side walls of said top and base sections are square, and means is provided for forming a cover on said top and base sections so as to seal said enclosure.

* * * * *